United States Patent [19]

Takei et al.

[11] Patent Number: 4,578,949

[45] Date of Patent: Apr. 1, 1986

[54] HOT GAS RECIPROCATING APPARATUS AND CONVECTOR HEATER

[75] Inventors: Yuji Takei, Gunma; Naotsugu Ishiki, Tokyo, both of Japan

[73] Assignee: Sanden Corporation, Gunma, Japan

[21] Appl. No.: 687,170

[22] Filed: Dec. 28, 1984

[30] Foreign Application Priority Data

Dec. 28, 1983 [JP] Japan ..... 58-249969
Dec. 28, 1983 [JP] Japan ..... 58-249970
Dec. 28, 1983 [JP] Japan ..... 58-249971

[51] Int. Cl.[4] ..... F02G 1/04
[52] U.S. Cl. ..... 60/517; 60/526
[58] Field of Search ..... 60/517, 524, 526

[56] References Cited

U.S. PATENT DOCUMENTS 811,879 2/1906 Silvey ..... 60/517
1,149,588 8/1915 Lovekin et al. ..... 60/517

OTHER PUBLICATIONS

Philips Technical Review, vol. 20, No. 9, pp. 246, 247, 250, Nov. 1959/1960, Ideal Thermodynamic Cycles, pp. 2–5, 120–123.

*Primary Examiner*—Allen M. Ostrager
*Attorney, Agent, or Firm*—Banner, Birch, McKie & Beckett

[57] ABSTRACT

A hot gas reciprocating apparatus is disclosed in which a displacer piston and power piston operate within a cylinder due to flow of medium gas which is heated and cooled through a heater and a cooler. The cylinder is divided into a upper chamber and lower chamber by the displacer piston, and the lower chamber is defined between displacer piston and power piston. The upper chamber and lower chamber are connected with one another through the heater, a regenerator and the cooler, whereby the medium gas flows into the lower chamber from the upper chamber or vice versa. The heater, which receives heat from heat sources, projects radially from the cylinder to extend over the heat source; and the cooler projects radially from the cylinder on an opposite side from which heater extends. The heater and cooler are axially spaced from one another along the axis of the cylinder. Thus, a high temperature difference between the heater and cooler is obtained to accomplish highly efficient operation of the hot gas reciprocating apparatus.

7 Claims, 9 Drawing Figures

HOT GAS RECIPROCATING APPARATUS AND CONVECTOR HEATER

TECHNICAL FIELD

This invention generally relates to a hot gas reciprocating apparatus, and more particularly, to a simplified Stirling cycle type engine in which heat from an external source is converted to useful mechanical energy.

BACKGROUND OF THE INVENTION

Stirling cycle type engines are well known in the prior art. A Stirling cycle machine is a device which operates on a regenerative thermodynamic cycle, with cyclic compression and expansion of the working fluid at different temperature levels, wherein the flow of the fluid is controlled by volume changes so that there is a net conversion of heat to work or vice versa. In a typical Stirling cycle engine, operating as a prime mover, heat is supplied to the working fluid at some high temperature Th, when the fluid is in a hot chamber. Part of the heat is converted to work when working fluid, due to the absorbed heat, expands and thereby pushes on a piston, which is coupled to a crank shaft that imparts rotary motion. The working fluid is then displaced by a displacer through a regenerator and forced into a cold chamber, which is at some lower temperature Tl. Thereafter, the working fluid is forced out of the cold chamber by the displacer through the regenerator into the hot chamber; and, as it passes through the regenerator reabsorbs some of the heat previously deposited there. In the hot chamber it again absorbs heat and the cycle of operation repeats itself.

In a Stirling cycle engine operating as a prime mover, the working fluid expansion takes place in the hot chamber, while most of the compression takes place in the cold chamber. As is appreciated by those familar with the art, when the Stirling cycle is used in a hot-gas engine, the working fluid expansion occurs in the hot chamber while the compression of the working fluid, during which heat is rejected, takes place in the cold chamber. In either type machine, the working fluid is shifted between the two chambers through a regenerator by means of a displacer. The motion of the displacer is generally synchronized with the piston motion by means of mechanical linkages which add to the complexity of the machine.

The theoretical maximum efficiency of a hot-gas engine is determined by the following formula:

$$(Th-Tl)/Th$$

wherein Th denotes the absolute temperature prevailing on the hot side of the engine and Tl the absolute temperature prevailing on the cold side of the engine. Therefore, it is important for satisfactory efficiency to maintain the temperature on the hot side of the engine as high as possible and on the cold side of the engine as low as possible.

SUMMARY OF THE INVENTION

It is a primary object of this invention to provide an improved hot gas reciprocating apparatus which achieves high efficiency.

It is another object of this invention to provide a hot gas reciprocating apparatus which is simple in construction and easy to manufacture.

It is another object of this invention to provide a new heating device which utilize the compact hot gas reciprocating apparatus.

A hot gas reciprocating apparatus according to this invention includes a power piston and a displacer both of which are slidably carried within a cylinder. The movable displacer divides an internal space of the cylinder into two chambers. These two chambers are connected to one another through a cooler, a regenerator and a heater. The cooler and heater each comprises a plurality of pole shaped members which include an outer tube element and inner tube element that define a double passage-way. The cooler and heater extend from an outer peripheral surface of the cylinder in opposite directions, axially offset from one another, and parallel to one another.

DETAILED DESCRIPTION OF THE PREFERRED EMBODIMENTS

Figure 1:
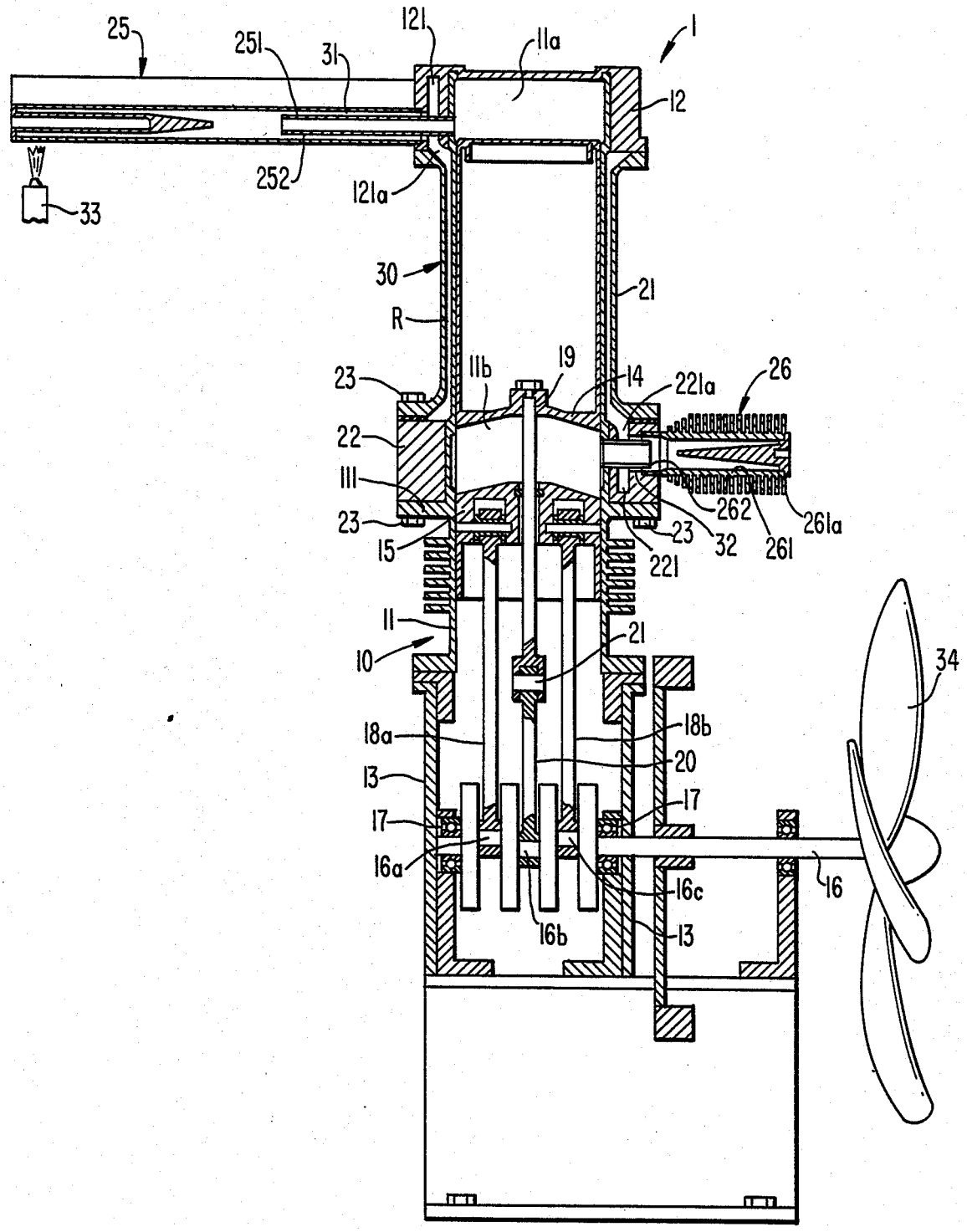
FIG. 1 is a vertical sectional view of a hot gas reciprocating apparatus according to one embodiment of this invention.

Referring to FIG. 1, a hot gas reciprocating apparatus according to one embodiment of this invention is shown. The apparatus 1 comprises an annular housing 10 having a cylinder 11, a cylinder cap 12 disposed on one end portion of cylinder 11 to close the opening in the one end portion, and a crank case 13.

A displacer piston 14 is slidably carried within cylinder 11 and divides the cylinder into two chambers. A power piston 15 is also slidably carried within cylinder 11 and placed in the lower portion of cylinder 11. A top surface of power piston 15 faces the bottom surface of displacer piston 14. An upper chamber of cylinder 11 functions as a heat chamber **11*a* and a space defined between displacer piston 14 and power piston 15 functions as a cold chamber 11*b*. Both pistons 14, 15 are linked to a crankshaft 15 which is rotatably supported in crank case 13 through bearings 17. Crankshaft 16 has three cranks 16*a*, 16*b*, 16*c* extending from it. The two outside cranks 16*a* and 16*c* extend from crankshaft 16 at the same angle and are linked to power piston 15 by two parallel connector rods 18*a*, 18*b*. Displacer piston 14 is actuated by middle crank 16*b*, which is offset by a certain angle from the other two cranks 16*a*, 16*c*. Displacer piston 14 is coupled to middle crank 16*b* through a rod 19 which is linked by a linkage 21 to a connector rod 20 fastened on crank 16*b***.

Figure 2:
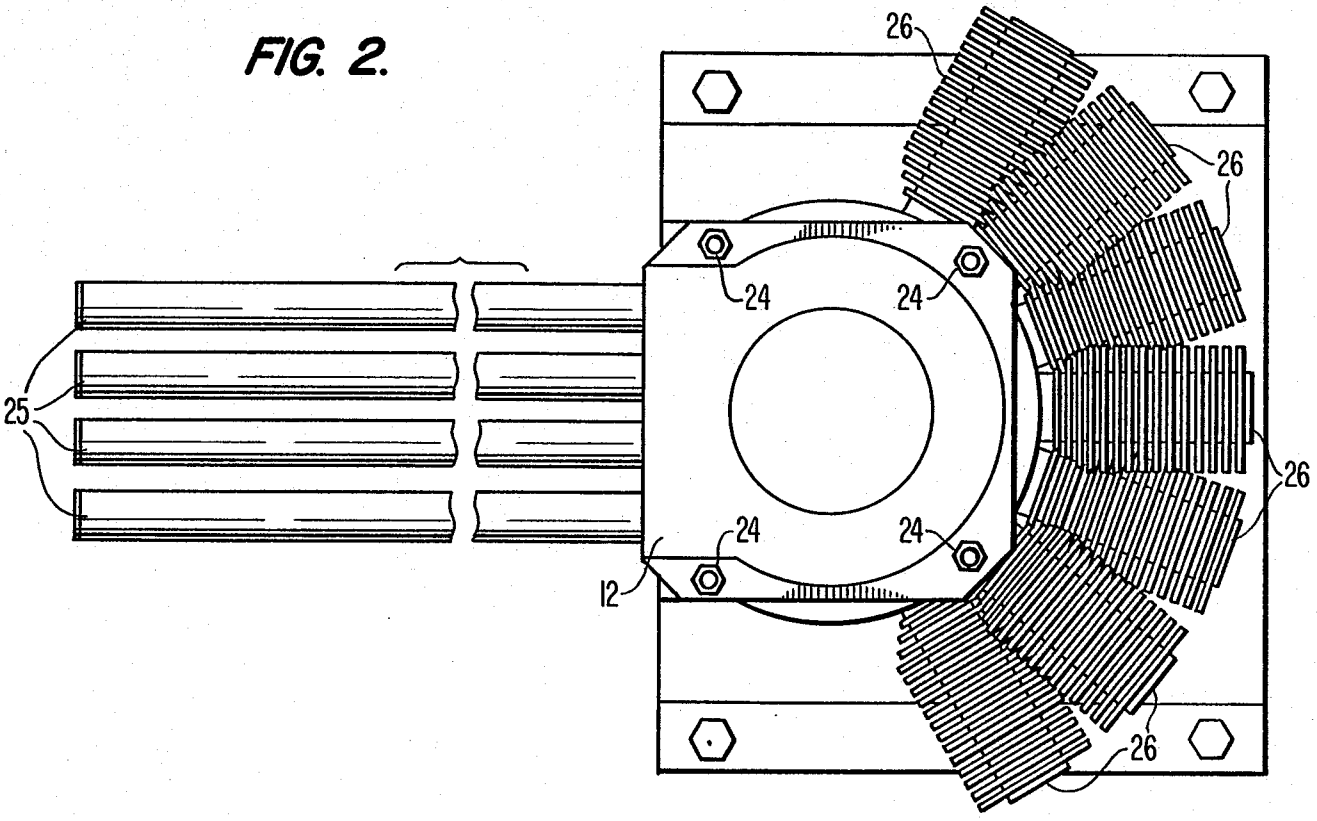
FIG. 2 is a top plan view of the hot gas reciprocating apparatus in FIG. 1.
Figure 3:
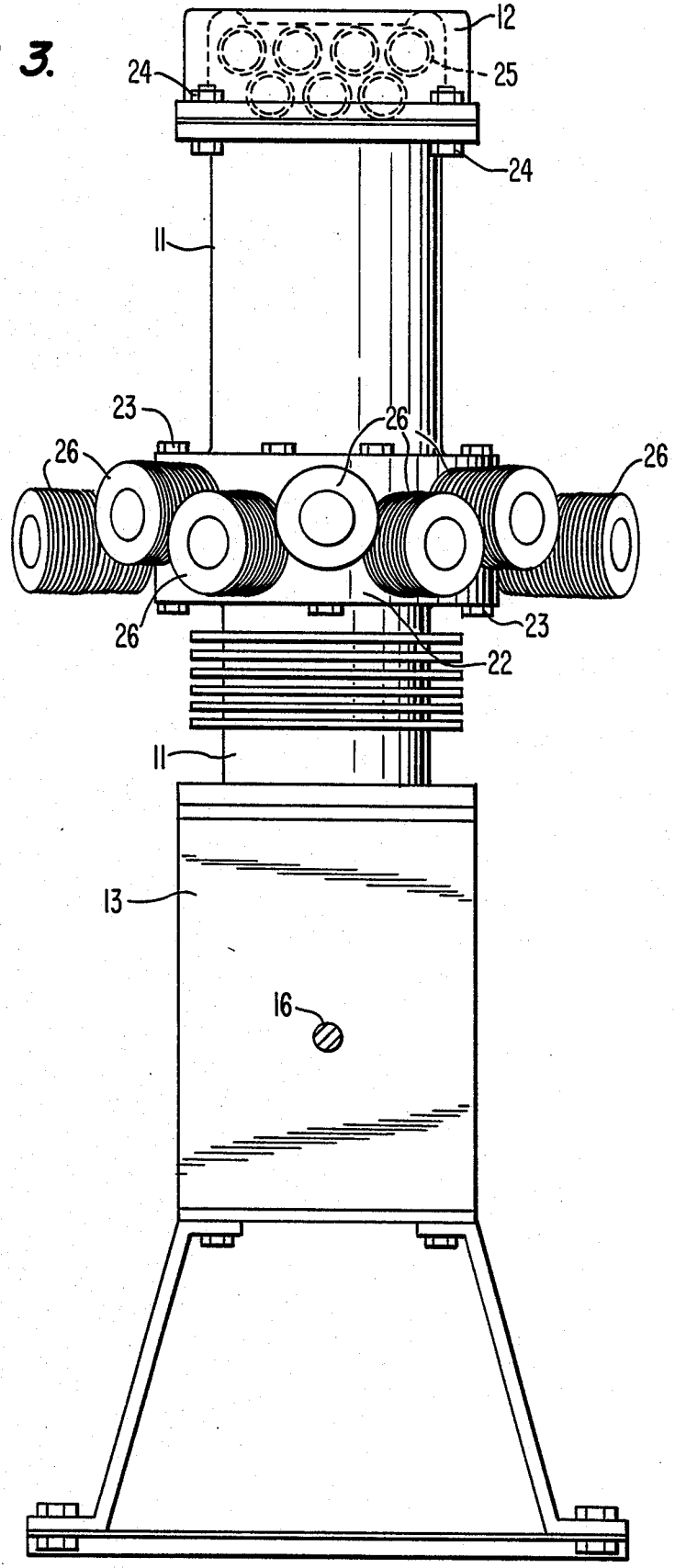
FIG. 3 is a side view of the hot gas reciprocating apparatus in FIG. 1.
Figure 4:
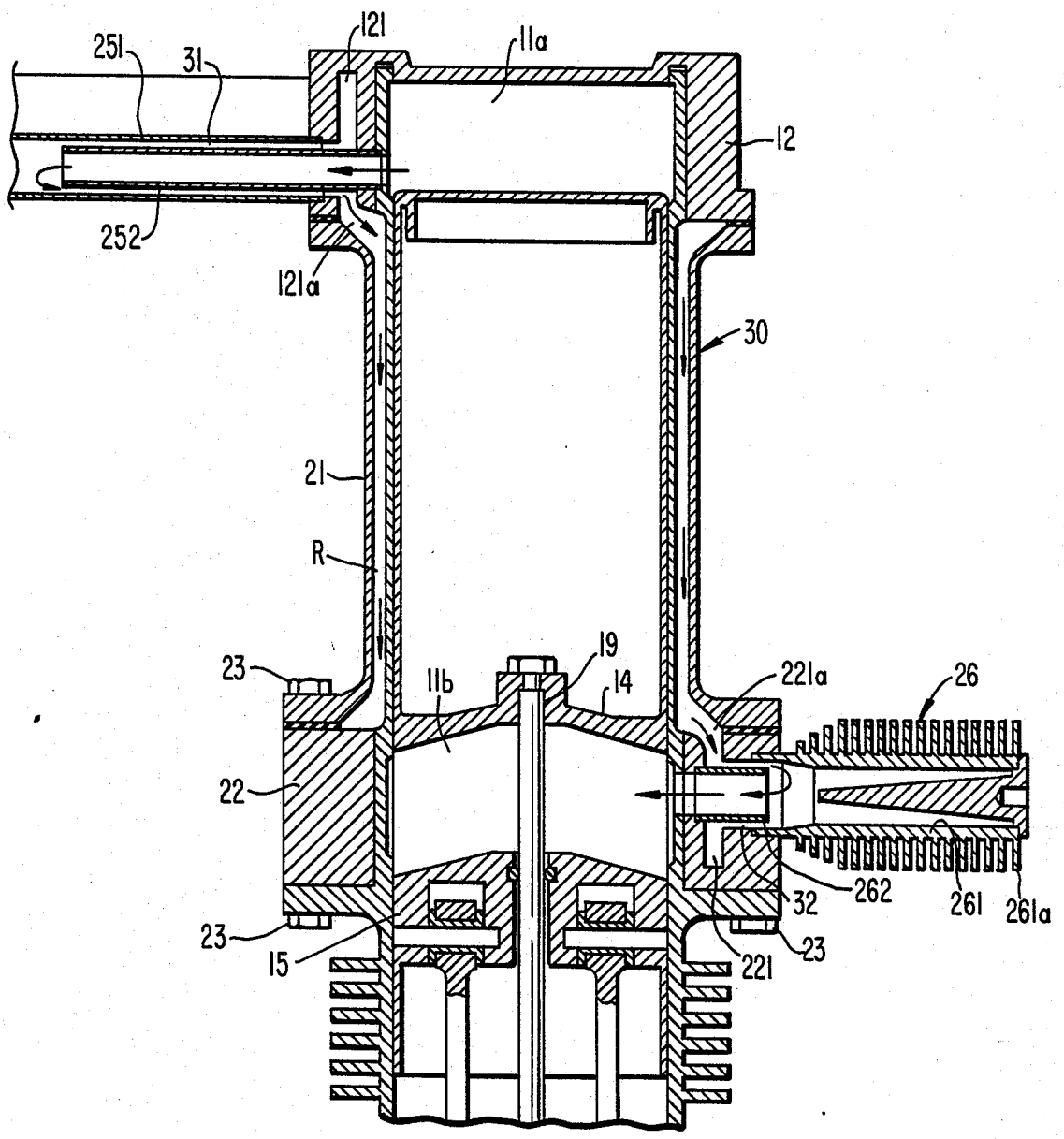
FIG. 4 is a partial cross-sectional view of the hot gas reciprocating apparatus, illustrating the flow of working fluid.

An annular cylindrical member 21 is disposed around an outer peripheral surface of cylinder 11. A gap between cylinder 11 and cylindrical member 21 defines a regenerating space R, i.e., a regenerator 30 is formed between the outer peripheral surface of cylinder 11 and the inner peripheral surface of cylindrical member 21. Cylindrical member 21 is placed around the upper portion of cylinder 11 and fixed on cylinder 11 through a connecting member 22 by a plurality of bolts 23. Connecting member 22 is supported on a radial flange portion 111 projecting radially from the outer peripheral surface of cylinder 11; and the lower end portion of cylindrical member 21 is placed on, and fastened to, the upper end surface of connecting member 22. The upper end surface of cylindrical member 21 fits against the bottom end surface of cylinder cap 12. As shown in FIGS. 2 and 3, cylinder cap 12 and cylindrical member 21 are fastened to one another by a plurality of bolts 24.

Referring to FIGS. 1 and 2, a plurality of heaters 25 extend radially from cylinder cap 12. Each heater 25 comprises an outer tube element 251 and an inner tube element 252. One end portion of outer tube element 251 is fixed to cylinder cap 12 and its other, outer end is closed. Outer tube element 251 communicates with the interior of inner tube element 252 and a hollow space 121 formed in cylinder cap 12. Hollow space 121 is connected to the regenerating space R through an opening 121*a*. Therefore, the interior of outer tube element 251 communicates with the space R of regenerator 30 through hollow space 121 and opening 121*a*. Also, one end portion of inner tube element 252 is fixed to cylinder 12 and opens to the interior of cylinder 12. Inner tube element 252 extends through hollow space 121 and the interior of outer tube element 251 with a small gap 31 to define passage-way for the medium gas.

Figure 5:
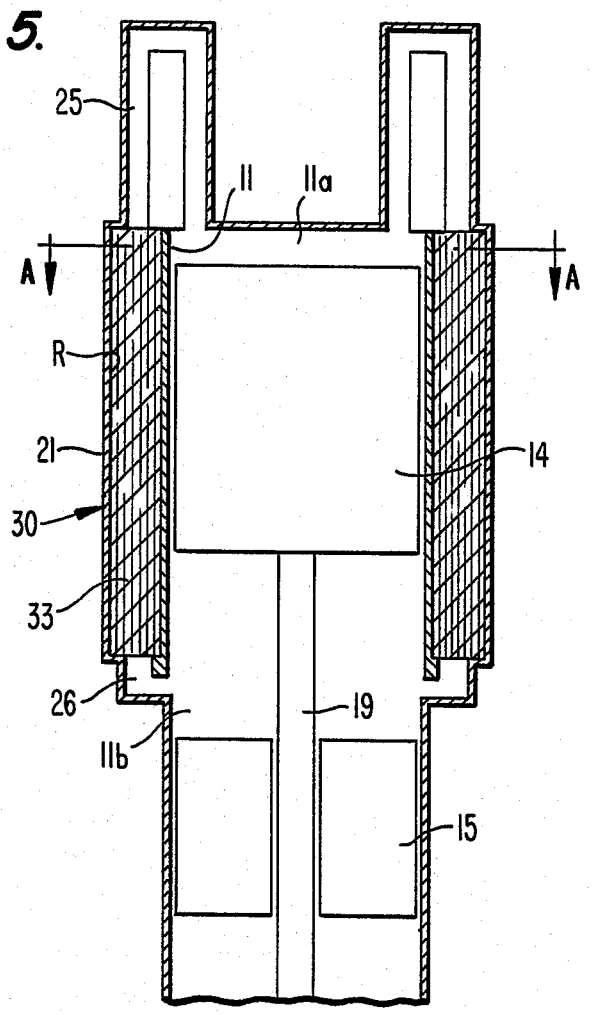
FIG. 5 is a schematic cross-sectional view of another embodiment of hot gas reciprocating apparatus.
Figure 6:
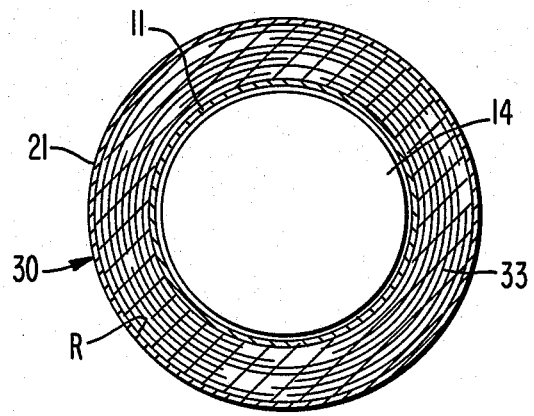
FIG. 6 is a cross-sectional view taken along line A—A in FIG. 5.

A plurality of coolers 26 extend radially from connecting member 22. Coolers 26 project from the opposite side of the apparatus as heaters 25, and are axially offset from heaters 25. Each cooler 26 comprises an outer tube element 261 with plural fins 261*a* and an inner tube element 262. One end of outer tube element 261 is closed, and its other end is open and fixed to connecting member 22 so that the interior of outer tube element 251 communicates with a hollow space 221 formed in connecting member 22. Hollow space 221 is connected to the space R of regenerator 30 through an opening 221*a*, whereby the interior of outer tube element 261 communicates with the space R of regenerator 30 through hollow space 221 and opening 221*a*. Inner tube element 262 is attached to cylinder 11 and extends into the interior of outer tube element 261 and hollow space 221 with a gap 32 which defines a passageway for the medium gas. Inner tube element 262 opens to the interior of cylinder 11 at the cold chamber 11*b*. Thus, heat chamber 11*a* and cold chamber 11*b* are connected with one another through heater 25, hollow space 121, regenerator space R, hollow space 221 and cooler 26. Regenerator 30 includes wire cloth 33 disposed in space R and wound up on the outer peripheral surface of cylinder 12. Wire cloth 33 is placed between heater 25 and cooler 26 to prevent unnecessary waste of the heat. During the passage of the medium gas from hot chamber 11*a* to cold chamber 116, the gas which has been heated by heaters 25, gives up heat in regenerator 30 before entering the cooler; and, when the gas flows back, it takes up the stored heat again prior to its entry into heaters 25. In the embodiment illustrated in FIGS. 5 and 6, additional wire cloth 33 is shown wound up on the outer peripheral surface of cylinder 11.

When this apparatus supplies mechanical energy, the heat from a heat source 33 is transmitted to the gas which is enclosed in the apparatus as the working medium through heaters 25. The heat left in the gas after expansion and after passing through regenerator 30 is absorbed by cooling air via coolers 26. The outer peripheral surface of outer tube element 261 of coolers 26 is provides with a plurality of fins 261*a* to promote heat exchange with coolers 26.

Figure 8:
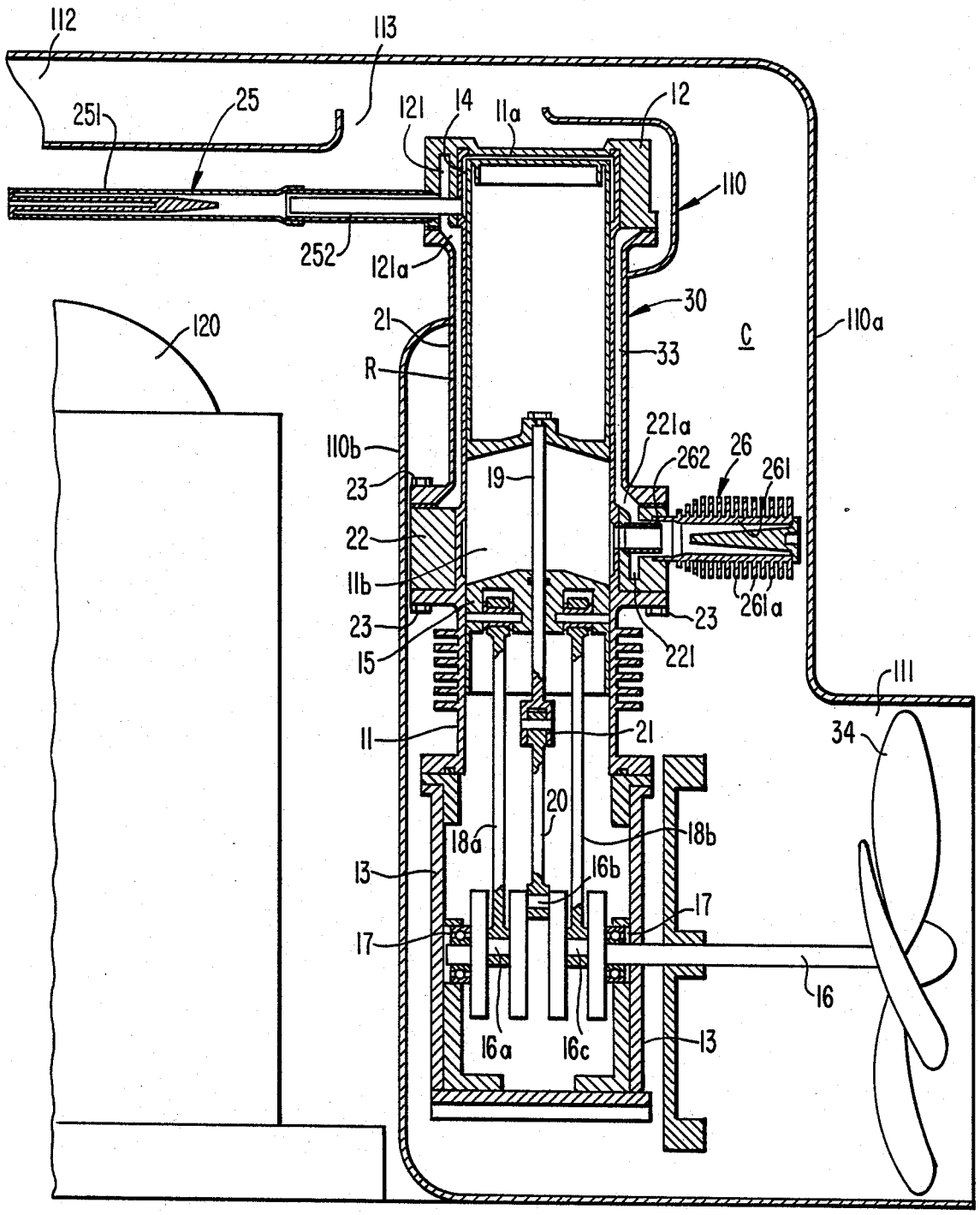
FIG. 8 is a vertical sectional view of a convector heater utilizing a hot gas reciprocating apparatus according to the first embodiment of this invention.
Figure 9:
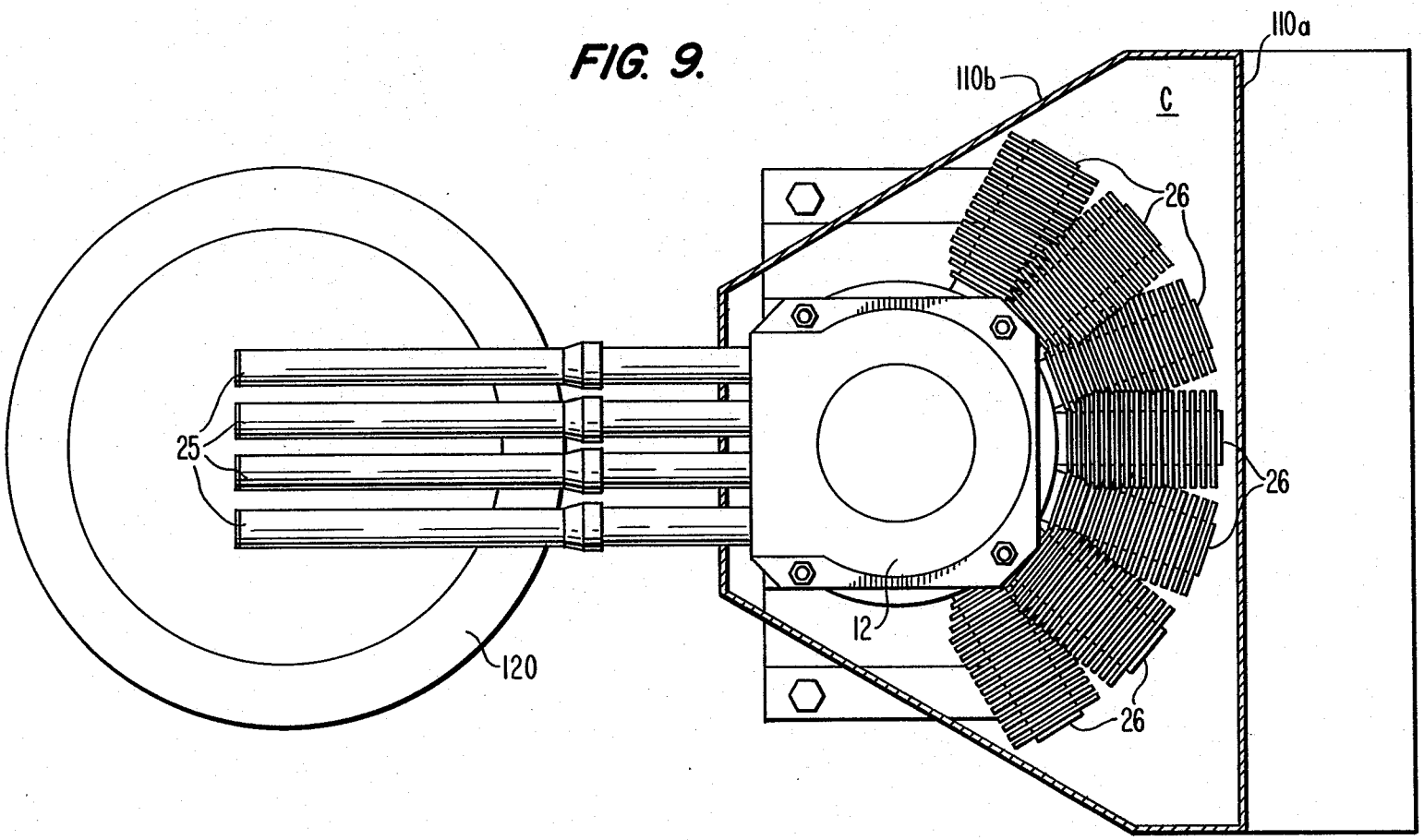
FIG. 9 is a top plan view of the heater in FIG. 8.

The cyclical thermal process by which the apparatus operates will be described with reference to FIGS. 1 and 8. Referring to FIG. 8 power piston 15 is in its lowermost position, while displacer piston 14 is in its uppermost position. All the gas in the system thus has been forced into cold chamber 11*b*, which is at its largest volume. Power piston 15 thereafter moves upward to compress the gas in cold chamber 11*b*; and displacer piston 14 moves downward to force the compressed gas through cooler 26, regenerator 30, heater 25 and into hot chamber 11*a*. When power piston 15 is in its uppermost position and displacer piston 14 has moved to a lower position wherein the volume of cold chamber 11*b* is at a minimum, all the compressed gas is in hot chamber 11*a*. The heat from heaters 25 causes the gas in hot chamber 11*a* to expand, and both power piston 15 and displacer piston 14 move downward to their lowest positions. While power piston 15 remains in its lowermost position, displacer piston 14 moves upward and pushes the gas from hot chamber 11*a*. During its passage from hot chamber 11*a* to cold water chamber 11*b*, the gas gives up a large part of its heat to regenerator 30 and its remaining heat to coolers 26. FIG. 1 illustrates displacer piston in its intermediate stage of pushing the gas into cold chamber 11*b*, prior to reaching its uppermost position shown in FIG. 8 wherein all gas has been forced into cold chamber 11*b*. The cycles of operation thereafter are repeated, with the cool gas passing from cold chamber 11*b* to hot chamber 11*a* recovering heat from regenerator 30.

Figure 7:
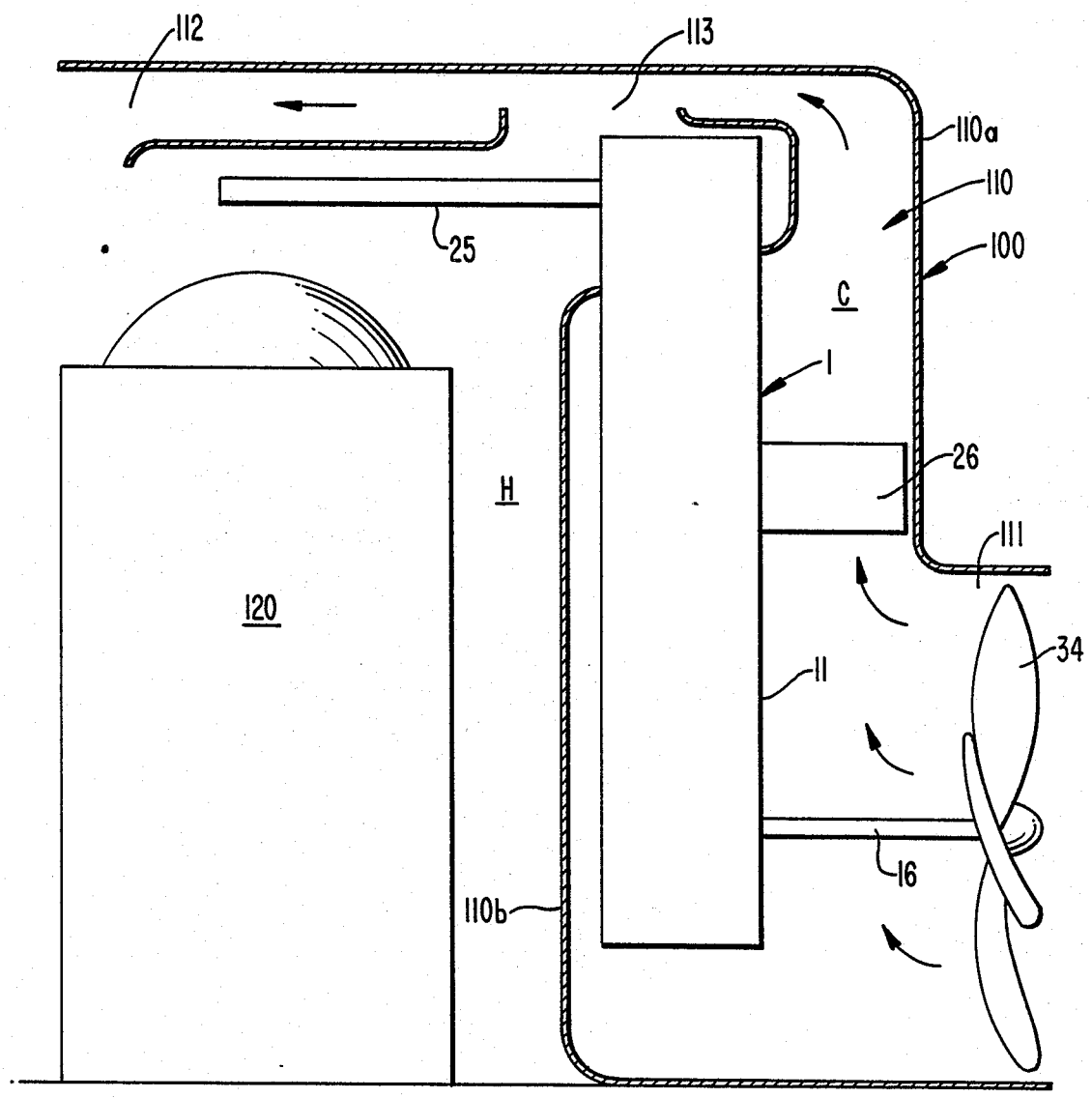
FIG. 7 is a diagrammatic view of a heating device which utilizes the hot gas reciprocating apparatus.

A forced air convection type heater 100 is shown in FIGS. 7 and 8, which utilizes a hot gas reciprocating apparatus, as illustrated in FIGS. 1–4. In the hot gas reciprocating apparatus contained in heater 100, similar parts are represented by the same reference numbers as in the embodiment shown in FIGS. 1–4. Heater 100 includes a blow duct 110 provided with a cold air intake opening 111 and a warm air supply opening 112, and a combustion apparatus or pipe 120 which supplies heat.

Blow duct 110 includes an outer duct element 110*a*, which is formed integral with an outer casing of heater 100, and an inner duct element 110*b* which divides the blow duct space C from heating space H in which combustion apparatus 120 is placed. An opening 113 is formed in a midway portion of inner duct element 110*b* to take in warm air from heating space H. The hot gas reciprocating apparatus 1 is disposed within blow duct 110. A blast fan 34 which is fixed on the outer terminal end of drive shaft 16 of apparatus 1, is placed in air intake opening 111 to draw in cold air from outside of heater 100 into blow duct 110. A main portion of apparatus 1, including coolers 26, is located in the blow duct and is thus exposed to the incoming cold air. The cold air thus flows into blow duct 110 due to operation of blast fan 34, and while passing through duct 110, cools the outer surface of apparatus 1 and effects heat exchange with the gas contained in the apparatus through coolers 26. During flow of the cold air toward warm air supply opening 112, it mixes with hot air supplied from heating space H through opening 113. The upper end portion of apparatus 1 extends into the heating space, and heaters 25 extend over the upper portion of combustion pipe 120 with a gap between them. Heaters 25 also extend through the area of the hot air passage-way which comprises opening 113. Therefore, heaters 25 of apparatus 1 are heated by combustion pipe 120.

In this construction of heater 100, when the gas enclosed in hot gas reciprocating apparatus 1 is heated by combustion pipe 120 through heaters 25, the heat left in the gas after expansion and after passing through regenerator 30 is absorbed by the cooling supplied by fan 34 via cooler 26. Apparatus 1 operates by the cyclical thermal process described previously with reference to FIGS. 1 and 8. Also, fan 34, which fixed on the outer terminal end of drive shaft 16, is rotated due to reciprocation of power piston 15 and displacer piston 14 through crank shaft 16.

As the result of the rotation of fan 34, cool air is taken into blow duct 110 through air intake opening 111 and during its flow toward warm air supply opening 112 cools cooler 26. Warm air flows into duct 110 from heating space H through opening 113 and mixes with the cool air. The cool air is thus warmed by the warm air and supplied to a room or rooms through opening 112.

As mentioned above, in this forced convector heater, the fan which causes the air flow within the heater is driven by the hot gas reciprocating apparatus, and most of the hot gas reciprocating apparatus is disposed in the blow duct. Only the heater of the reciprocating apparatus extends over the upper portion of the combustion apparatus, and is separated from the blow duct. Therefore, the temperature difference between the heater and the cooler of the reciprocating apparatus is securely established, to thereby ensure the high efficiency of the reciprocating apparatus.

This invention has been described in detailed in connection with the preferred embodiments, but these are examples only and this invention is not restricted thereto. It will be easily understood by those skilled in the art that other variations and modifications can be easily made within the scope of this invention.

We claim:

1. In a hot gas reciprocating apparatus including a cylinder having a cylinder cap, a power piston and a displacer piston both slidably carried within said cylinder, said displacer piston dividing the interior of said cyclinder into two chambers one of which is located between said power piston and displacer piston, said two chambers being connected to one another through cooler means for cooling a fluid in said apparatus, a regenerator and heater means for heating a fluid in said apparatus, the improvement comprising said heater means extending radially from a side surface of said cylinder, said cooler means extending radially from an opposite side surface of said cylinder, and said heater means being axially spaced along said cyclinder from said cooler means.

2. The hot gas reciprocating apparatus of claim 1 wherein said heater means comprises a plurality of heaters each of which includes an outer tube element and an inner tube element disposed within an interior of said outer tube element with a gap between the tube elements to define a fluid passage-way.

3. The hot gas reciprocating apparatus of claim 2 wherein said cooler means comprises a plurality of coolers each of which includes an outer tube element with a plurality of fins to promote heat exchange and an inner tube element extending into an interior of said outer tube element with a gap between the tube elements to define a fluid passage-way.

4. The hot gas reciprocating apparatus of claim 1 wherein said regenerator is defined between an outer surface of said cylinder and an outer annular member which is disposed around the outer peripheral surface of said cylinder with a gap between said cylinder and said outer annular member, and a regenerative metal disposed in said gap between said cylinder and said outer annular member.

5. The hot gas reciprocating apparatus of claim 4 wherein said regenerative metal comprises a wire cloth.

6. In a forced convector heater including a blow duct having a cold air intake opening and a warm air supply opening, and the blow duct dividing a passage for cold air from a heating space, a combustion apparatus disposed in the heating space and a blower fan disposed in said cold air intake opening, the improvement comprising a hot gas reciprocating apparatus disposed in said blow duct and said fan fixed on outer terminal end of a crankshaft of said apparatus, said hot gas reciprocating apparatus having a heater means for heating fluid in said apparatus and a cooler means for cooling fluid in said apparatus, and said heater means projecting radially from said hot gas reciprocating apparatus to extend adjacent an upper portion of said combustion apparatus.

7. The forced convector type heater of claim 6 wherein said cooler means of said hot gas reciprocating apparatus is exposed in said blow duct.

* * * * *

UNITED STATES PATENT AND TRADEMARK OFFICE

CERTIFICATE OF CORRECTION

PATENT NO. : 4,578,949

DATED : April 1, 1986

INVENTOR(S) : Yuji Takei and Naotsugu Ishiki

It is certified that error appears in the above-identified patent and that said Letters Patent is hereby corrected as shown below:

Column 2, line 58, change "15" to —16—.

Signed and Sealed this

*Eighth* Day of *July 1986*

[SEAL]

*Attest:*

DONALD J. QUIGG

*Attesting Officer*

*Commissioner of Patents and Trademarks*